United States Patent [19]

Brazzoli

[11] Patent Number: 4,981,025

[45] Date of Patent: Jan. 1, 1991

[54] DYE-BATH ACCELERATING DEVICE

[75] Inventor: Gaimpietro Brazzoli, Milan, Italy

[73] Assignee: Brazzoli, s.p.a., Italy

[21] Appl. No.: 441,845

[22] Filed: Nov. 27, 1989

[30] Foreign Application Priority Data

Mar. 31, 1989 [IT] Italy ..... 19988 A/89
Jul. 18, 1989 [IT] Italy ..... 21214 A/89

[51] Int. Cl.[5] ..... D06B 3/28
[52] U.S. Cl. ..... 68/178; 68/184
[58] Field of Search ..... 68/177, 178, 184

[56] References Cited

U.S. PATENT DOCUMENTS 3,510,251 5/1970 Fujii et al. ..... 68/177 X
3,949,580 4/1976 Trullas ..... 68/177
3,982,411 9/1976 Kreitz ..... 68/177
4,019,351 4/1977 Mizutani et al. ..... 68/177
4,474,039 10/1984 Yamada ..... 68/177

FOREIGN PATENT DOCUMENTS 0078880 7/1976 Japan ..... 68/177

*Primary Examiner*—Philip R. Coe
*Attorney, Agent, or Firm*—Shlesinger, Fitzsimmons & Shlesinger

[57] ABSTRACT

In a dye-bath machine, the fabric to be dyed passes in an endless loop through an overflow conduit and through a kier containing a liquid dye which is recirculated by a first pump from the kier to the upper end of the overflow conduit. The passage of the fabric through the overflow conduit is accelerated by the incorporation in the conduit of a venturi section through which dye from the bottom of the kier is pumped by a second pump, and in such manner as to accelerate the passage of the fabric through the conduit.

6 Claims, 4 Drawing Sheets

DYE-BATH ACCELERATING DEVICE

Figure 1:
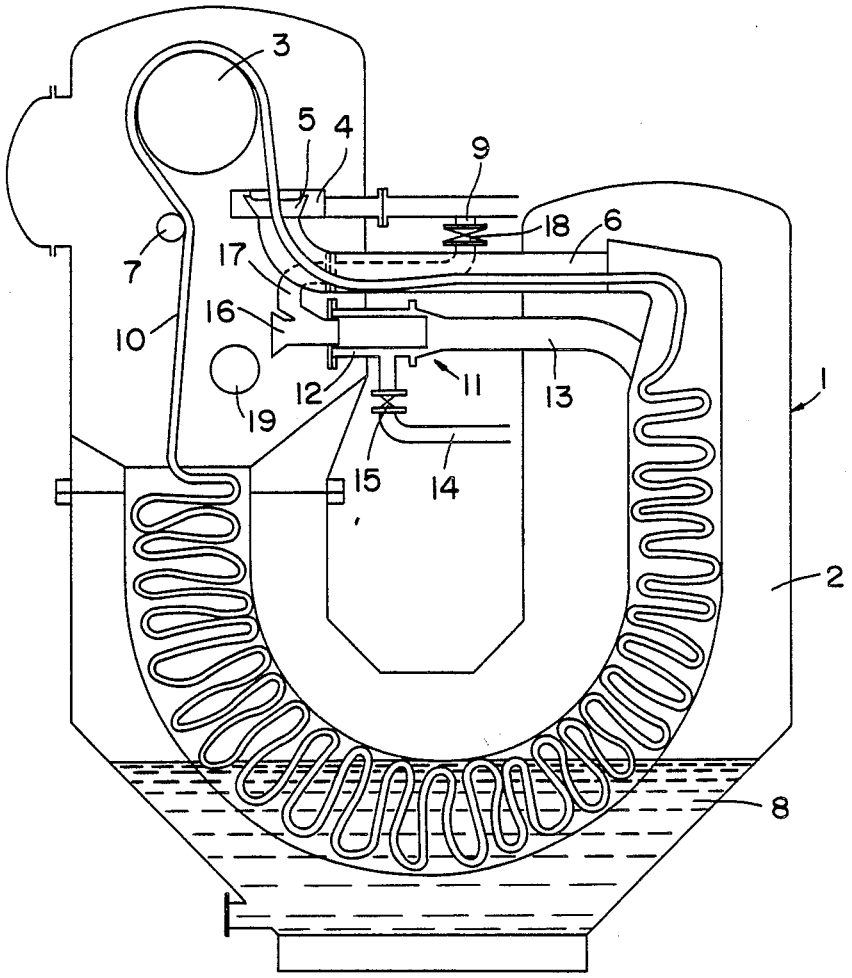

The finding belongs to the field of machines of the Overflow type for dyeing of fabric and it refers to a means for accelerating the dye-bath.

Dyeing machines operating with the Overflow system for the dyeing of fabrics are already known in the field. They are made up of kiers having a conduit through which the fabric passes wound up in a cord-like fashion, said conduit being connected to their tops in a subhorizontal position. The fabric is taken to the mouth of said conduit being funnel-shaped at the top by a lifting reel which pulls the tip of the wound-up cord in the kier reaching, the vertical base of the reel thanks to the force given by the weight of the fabric on the opposite side of said tip.

The dragging means of the fabric in the Overflow conduit is made up of the same dye-bath contained in a basin, called the introduction basin, in which is housed said funnel and from which said liquid, taken from the kier, preheated by passing through a heat exchanger and brought to the basin by means of a pump, overflows into the funnel. The ring-shaped fabric after a certain number of these turns, kier, reel and Overflow conduit gets the required colouring.

Since this machine treats fabrics with care it is particularly suitable to dye plush fabrics, delicate fabrics in particular those of vegetable or animal fibre without causing damage or movement of the woof.

This kind of machine however, has a few drawbacks in that it requires a rather high water absorbtion ratio to make the fabric, which folds-up vertically in the kier, float or in an accecive length of the kier and/or vertical distance of the Overflow conduit from the kier so that the heavy accumulation of fabric provides the necessary urge to move the fabric in the kier towards the reel; and above all in that the translation velocity of the fabric through the flow conduit is rather slow (about 150 mt. per minute) therefore a rather long dyeing time.

Acceleration of the translation velocity of the fabric has been obtained to a certain degree, by blowing air or steam into the Overflow circuit, but these systems cannot be applied to all kinds of fabrics accepted by Overflow machines, but only to a small range of delicate fabrics.

We have found, and it is the object of the present invention, that if the velocity of the dye-bath that contains the fabric is accelerated after a first contact with it, it is possible to increase the translation velocity of the fabric considerably, more than doubling the time, thus obtaining both the advantage of diminishing the dyeing time and reducing the soaking time of the fabric folded in the kier and therefore the time in which the fabric suffers for the folds.

The finding consists in joining an accelerating device to the fabric conveying device of the traditional Overflow parallel to the first. Said accelerating device is made up by a subhorizontal tube having the structure of a nozzle-like choking device in which is inserted the end of a funnel-shaped mouthpiece for the fabric, the front section being hydraulicly joined to the adduction tubing of the bath to the Overflow basin by a tubing intercepted by a valve, while the intermediate annular chamber formed between the internal wall of the first section of the choking device and the end section of the funnel-shaped mouthpiece is joined by a tubing to a second high head pump which has a high pressure but low volume delivery equal to a fraction of that volume delivered by the pump feeding the Overflow conduit, and which draws from the bottom of the kier more dye-bath with which by the Venturi effect, is brought about an acceleration of the dye-bath coming from the Overflow conduit and consequently of the fabric in it.

It turns out that the fabric previously introduced in the form of a ring-shaped cord in said accelerator, is at first soaked and surrounded by the dye-bath coming from the Overflow conduit and successively the dye-bath introduced, as noted above, by the high head pump at high pressure in the choking device works as an accelerator on the dye-bath coming from the Overflow conduit considerably increasing the speed and consequently that of the fabric therein contained.

The machine is also capable of working as a traditional Overflow excluding from the circuit the accelerating device according to the patent.

A second form of realization has been found, which allows to realize a dyeing machine for fabrics with both devices into an only device capable of working traditionally according to the Overflow method of dyeing or in an accelerated way without having to rearrange the fabric according to the needs into the mouthpiece of one or the other of the two parallel devices. With such devices the performances of the machine are improved.

The device consists in a conduit at an inclined position having the structure of a nozzle-like choking device in the first section of which is inserted the end section of a funnel-shaped mouthpiece for the introduction of the fabric, said mouthpiece being enclosed and in communication with an annular chamber into which is introduced the dye-bath drawn by a pump from the bottom of the kier, while the intermediate annular chamber formed between the internal wall of the first section of the choking device and the end section of the funnel-like mouthpiece, is connected by a tubing intercepted by a valve to a second high head pump, which draws from the bottom of the kier more dye-bath with which, by the Venturi effect, is brought about an acceleration of the dye-bath coming from the first conduit and consequently of the fabric in it contained.

Acting therefore on the valve placed on the tubing connected to the high head pump it is possible to make the machine work as a traditional Overflow excluding the acceleration function, on the other hand, if we reactivate it the desired acceleration can be obtained.

Figure 2:
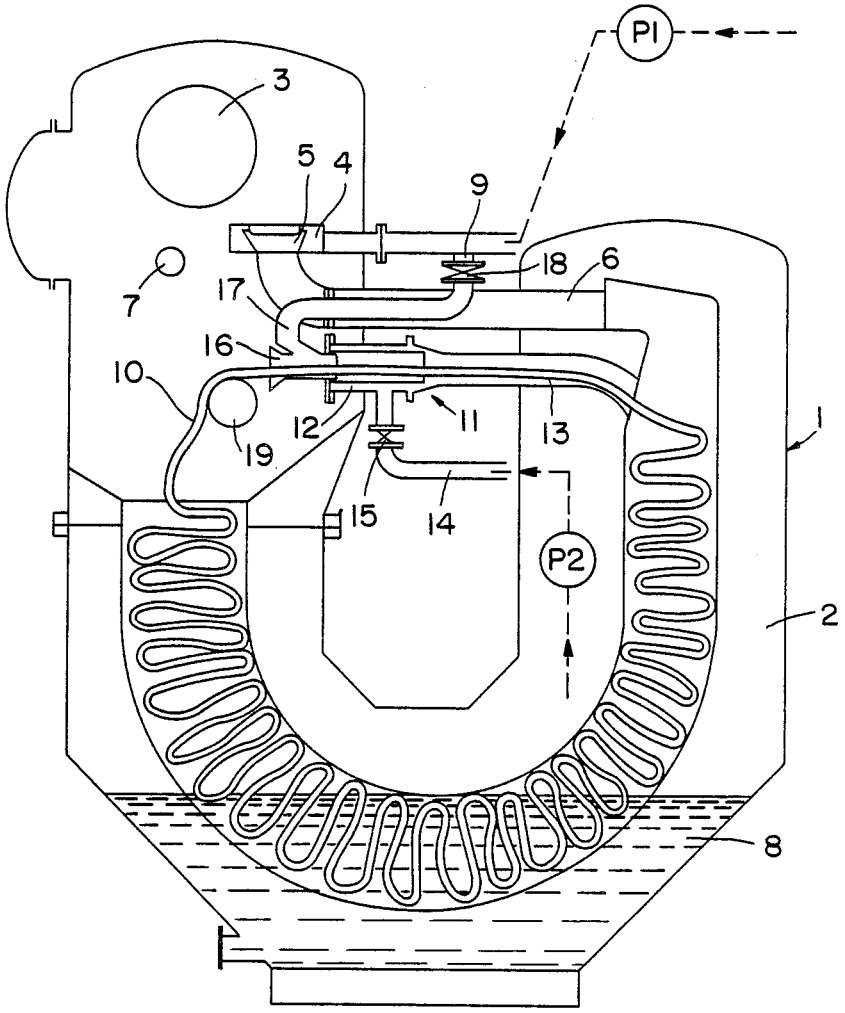
Figure 3:
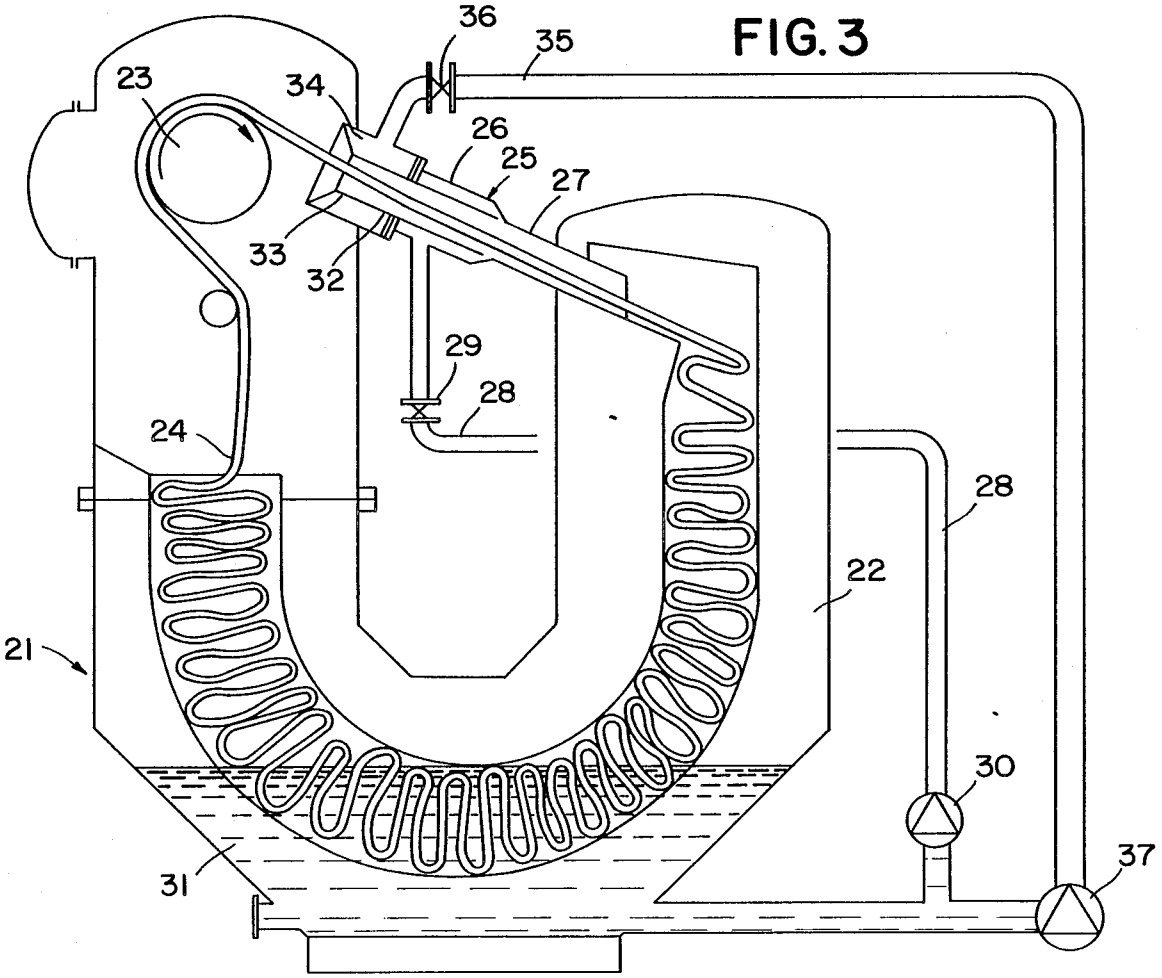
Figure 4:
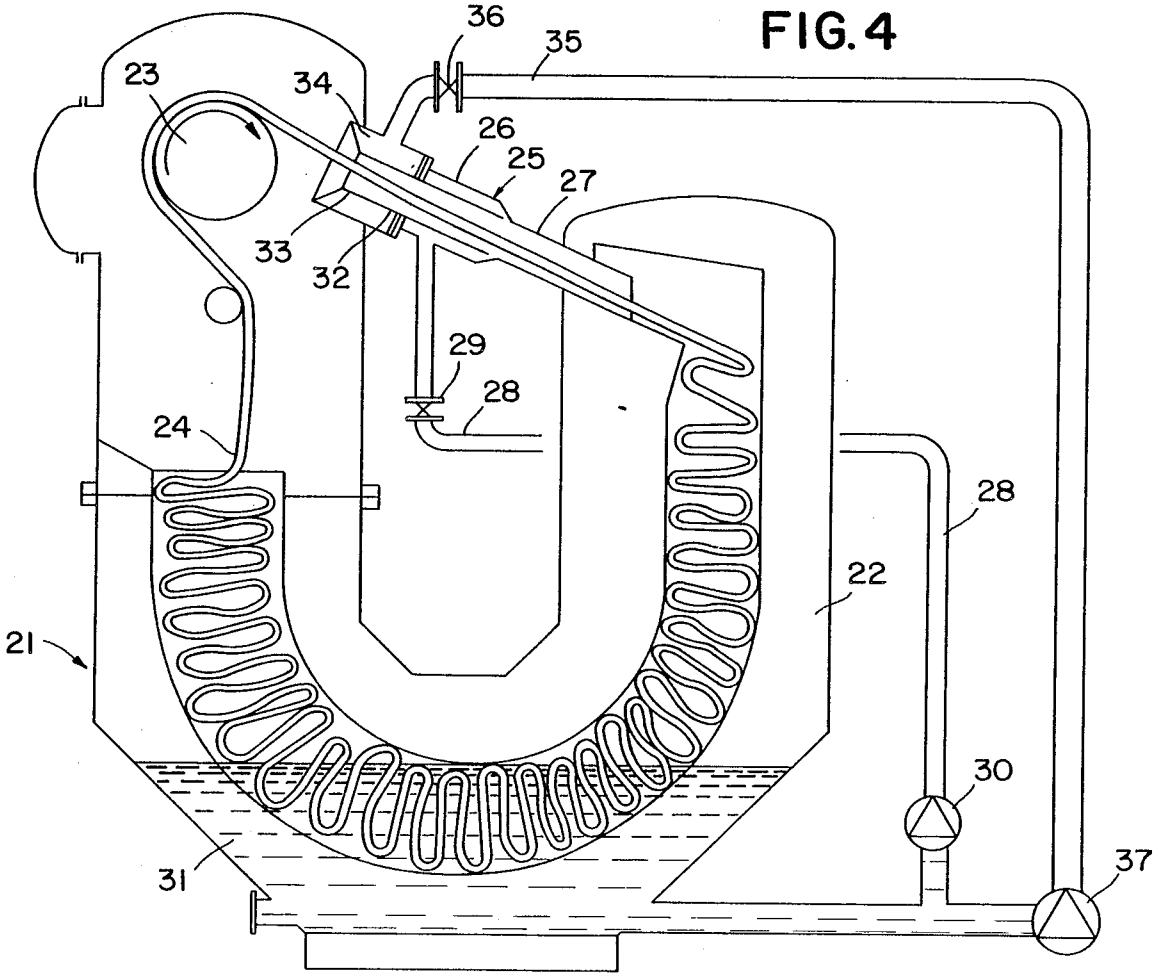

The invention will be better explained with the description of two examples of realization to be considered exemplifying and not limiting in any way and illustrated by the enclosed drawings in which:

FIG. 1—The machine according to the first example of realization of the invention working as a traditional Overflow;

FIG. 2—The machine according to FIG. 1 working with accelerator of the dye-bath;

FIG. 3—The machine according to the second example of realization of the invention working as a traditional Overflow;

FIG. 4—The machine according FIG. 3 working with the acceleration of the dye-bath.

With reference to the FIG. 1 and 2 we present a dyeing machine according to the first example of the invention made up by: a kier 2 on the top of which is arranged a reel 3 to pull the fabric, the Overflow basin 4 in which is inserted the Overflow funnel 5 and the relative conduit 6. The dye-bath 8 contained in the bottom of the kier 2 gets to the Overflow basin 4 through the conduit 9 urged by a pump which is indicated at in p1 FIG. 2 of the drawings, and which draws the liquid from the bottom of the kier 2 and after having passed it through a heat exchanger, also not included in the drawings, it is introduced in conduit 9 and from here to basin 4 and overflowing in funnel 5 and into the Overflow conduit 6 with the fabric 10.

With this device the machine works as a traditional Overflow so that the fabric 10 formed into a ring and soaking in the kier is pulled by the reel 3 and made to adhere to it by a previous transit on the roller 7 dropped into the Overflow funnel and from here to conduit 6 where it is delicately dragged by the liquid therein running returning in the kier where it folds up, see FIG. 1.

Parallel to the Overflow conduit is arranged a choking device 11 made up by: a cylindrical first section 12 joining in a cone-shaped manner to a cylindrical conduit of less diameter 13, said section 12 being connected at a median position to a tube 14 provided with an interception valve 15 coming from a high head pump p2 (FIG. 2) drawing the dye-bath 8 from the bottom of the kier 2 directing it at a high speed through the tubing 14 to the first section 12 of the choking device.

In the said cylindrical first section 12 of the choking device 11 is also inserted coaxially and for the whole length of said cylindrical section 12, the end section of a tube 16 having a funnel-shaped mouthpiece and to which is joined a branch pipe 17 of said funnel-shaped mouthpiece to the conduction tubing 9 of the dye-bath to the Overflow basin tubing 17 being intercepted by a valve 18.

Facing the funnel-shaped mouthpiece of tube 16 is arranged a reel 19 working in neutral or operated by a motor.

With this system, see FIG. 2, the cord-like fabric coming from the kier, after having passed on the reel 19, is directed through funnel 16 to the choking device 11 at this point rather dry and thus here soaked by the dye-bath sent through conduit 17 branching from conduit 9 and dipped in it and subsequently proceeding through the choking device and receiving with the dye-bath containing it, a considerable acceleration by dye-bath 8 introduced under pressure in the annular chamber between the cylindrical first section 12 of the choking device and the tubing section 12 in it coaxially introduced.

We have found that with this system, it is possible to treat delicate fabrics at a high speed, up to 400 mt/per minute and above to that normally achievable using the traditional Overflow system.

We shall now describe the second example.

With reference to FIG. 3 and 4 a machine according to the invention made up by: a kier 22 on the top of which is arranged a reel 23 to pull the fabric 24. Facing the reel 23 at an inclined position towards the fabric collecting basin is arranged the device according to the invention formed by a choking device 25 having a cylindrical first section 26 joining in a cone-shaped manner to the cylindrical conduit of less diameter 27.

The section 26 is joined at about a median position to a tube 28 provided with an interception valve 29 and coming from a high head pump 30 drawing the dye-bath 31 from the bottom of the kier 22 directing it at a high speed through the tubing 28 to the first section 26 of the choking device. On the first section 26 of the choking device 25 there is also set up coaxially in the interior section thereof a conduit 32 having a funnel-shaped mouthpiece for receiving fabric 24, and having therein also an opening 33 allowing it to communicate with an annular chamber 34 set up on the first section 26 of the choking device.

The chamber 34 enclosing the tube 32 is in turn joined to a conduit 35 provided with an interception valve 36 and to a pump 37 which draws the dye-bath 31 from the bottom of the kier 22.

Its functioning is now described:

When the machine works as a traditional Overflow, the fabric 34 formed into a ring and soaking in the kier 22, is pulled by the reel 23 and dropped in the funnel 32 and here dipped in the dye-bath, which has been recirculated by pump 37 through conduit 35 and chamber 34 by opening 33 into the funnel-shaped tube 32, and finally returning into the kier where it folds up.

When the interception valve 29 is also open, the fabric is dipped in the dye-bath coming from the traditional Overflow conduit 35, and receives a considerable acceleration in the choking device 25 by the dye-bath introduced under pressure in the annular chamber formed between the cylindrical first section 26 of the choking device and the tubing section 32 located therein.

I claim:

1. An accelerating device for a dye-bath machine of the type in which a feed roll is positioned adjacent the upper end of a kier to convey a length of fabric, which is to be dyed, in a loop through an overflow conduit to the upper end of the underlying kier, which contains a liquid dye that is recirculated by a first pump from said kier to said overflow conduit, said device comprising a second conduit communicating at one end with said kier adjacent or axially of said upper end thereof, and having at its opposite end an inlet for receiving and directing said loop of fabric through said second conduit to said kier, venturi means disposed in said second conduit intermediate the ends thereof, and a second pump for recirculating said liquid dye from said kier through said venturi means thereby to accelerate the passage of said fabric through said second conduit to said kier, said second pump being a high head pump having a delivery equal to a fraction of said first pump.

2. Accelerating device for dye-bath in Overflow machines according to claim 1, characterized by the fact that said venturi means comprises a nozzle-like choking device having at one end a funnel-shaped mouthpiece defining the inlet end of the second conduit and being hydraulically joined to the dye-bath overflow conduit, and having at its opposite end a tubular section extending into said second conduit and surrounded by an annular chamber connected to said second pump which brings about an acceleration of the dye-bath coming from the overflow conduit and consequently the fabric passing through said second conduit.

3. Accelerating device for dye-bath in Overflow machines according to claim 1, characterized by the fact that said second conduit is arranged at an inclined position, and said venturi means comprises a nozzle-like choking device mounted in the inlet end of said second conduit and having at one end a funnel-shaped mouthpiece for the introduction of the fabric and being in communication with said overflow conduit, and having at its opposite end a tubular section surrounded by an annular chamber which is connected to said second pump, which draws from the bottom of the kier more dye-bath with which, by the Venturi effect of said choking device, is brought about an acceleration of the dye-bath coming to the second conduit from the overflow conduit, and consequently an acceleration of the fabric passing through said second conduit.

4. An accelerating device as defined in claim 1, wherein said second conduit is disposed substantially horizontally, and means is provided for selectively connecting said second conduit adjacent said inlet end thereof with said overflow conduit.

5. An accelerating device as defined in claim 4, including for selectively connecting said second pump means to said venturi means.

6. An accelerating device as defined in claim 1, wherein said second conduit is inclined to the vertical, and said overflow conduit comprises an annular chamber surrounding said inlet end of said second conduit and communicating with said second conduit to permit recirculated liquid dye to enter said second conduit.

* * * * *